United States Patent [19]

Runner

[11] Patent Number: 4,498,676

[45] Date of Patent: Feb. 12, 1985

[54] SYSTEM FOR PRACTICING ROPING

[76] Inventor: Robert R. Runner, P.O. Box 307, Pavillion, Wyo. 82523

[21] Appl. No.: 606,160

[22] Filed: May 2, 1984

[51] Int. Cl.[3] ..... F41J 9/02; A63B 67/06

[52] U.S. Cl. ..... 273/336

[58] Field of Search ..... 273/336, 339, 359

[56] References Cited

U.S. PATENT DOCUMENTS

| | | | |
|---|---|---|---|
| 3,303,821 | 2/1967 | Harris | 273/359 X |
| 3,711,098 | 1/1973 | McCord | 273/336 |
| 3,776,553 | 12/1973 | Kelton | 273/339 |
| 3,802,706 | 4/1974 | Hamm | 273/339 |
| 3,947,033 | 3/1976 | Bennett | 273/339 |
| 4,136,874 | 1/1979 | McCord | 273/339 |
| 4,266,779 | 5/1981 | English | 273/359 |

*Primary Examiner*—William H. Grieb

*Attorney, Agent, or Firm*—Dean P. Edmundson

[57] ABSTRACT

A system is described for use by a person practicing the art of roping a moving target (e.g., a calf or steer) which does not require the use of live animals. The system includes (a) stationary support means adapted to support the person roping; (b) movable target means simulating an animal to be roped; and (c) propelling means, actuatable by the person roping, which is adapted to propel the target means away from the stationary support means in a manner such that the person may practice the art of roping the target.

21 Claims, 8 Drawing Figures

FIG. 5
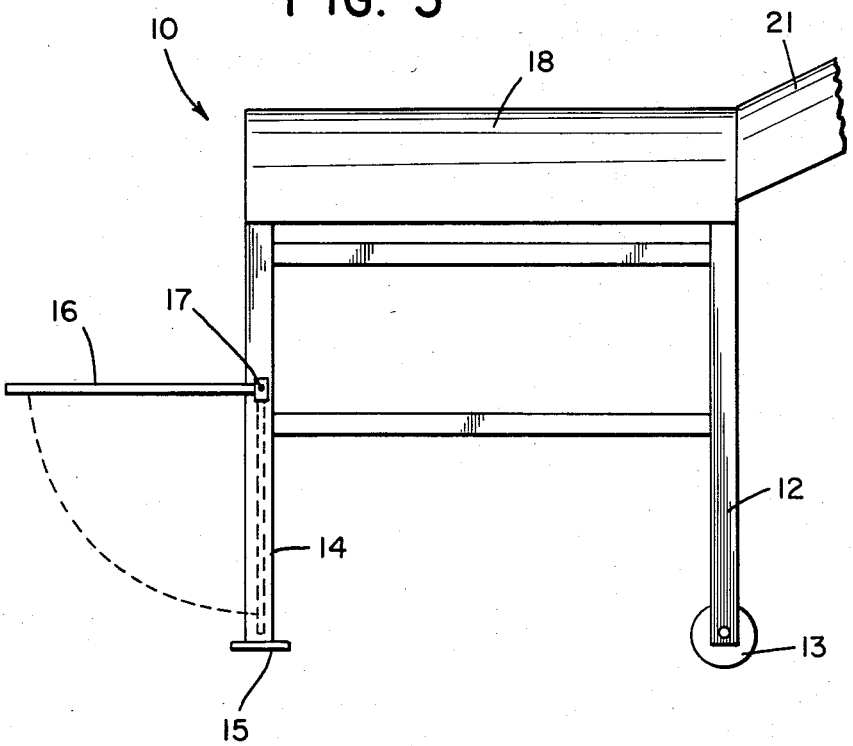
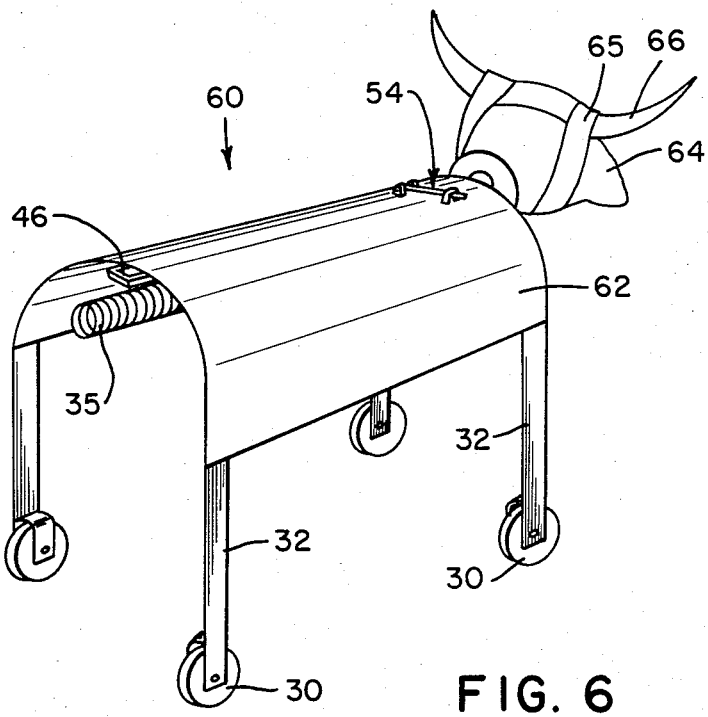
FIG. 6

SYSTEM FOR PRACTICING ROPING

Field of the Invention

This invention relates to practicing and training systems. More particularly, this invention relates to systems for practicing and training in the art of roping, especially the art of roping moving calves and steers.

BACKGROUND OF THE INVENTION

The art of roping calves and steers from horseback is not only a sport but is also an integral part of ranch work in this and other countries. Persons who are inexperienced in the art of roping, or persons who feel the need to hone their skills in the art, typically must arrange for a horse, a pen of calves or steers, a release chute for a calf or steer to exit from, and a helper to release the animal from the chute at the desired time. This manner of practicing naturally involves significant expense in terms of animals, equipment and facilities. Furthermore, there is always the attendant risk of injury to the animals. Moreover, a mis-cue or failure of proper performance by the horse interferes with the rider's act of roping and may prevent the attainment of the desired skills.

Although plastic calf head or steer horn forms are available which are intended to be secured to a bale of straw or hay for roping practice, they represent entirely stationary objects. Accordingly, skills for roping moving objects are not tested or refined.

More recently there have been developed mechanical devices which simulate the movement of a steer when they are pulled across a field or arena by a horse ridden by another rider. Then the person practicing the art of roping from horseback rides behind the device and attempts to rope it. While such devices do avoid the need for a live steer, the person practicing the roping still requires a horse. Furthermore, at least one other person and another horse are required to assist. Even if means are provided to power the device without the need for a second horse and rider, the person practicing must still work from his own horse.

Another system has been proposed in which the person practicing sits on top of a chute containing a live calf and then ropes the calf when it is released. Although this system does not require the person practicing to have a suitable roping horse, it is still necessary to use a live calf.

There has not heretofore been proposed a suitable system which would enable a person to practice the art of roping a moving calf or steer without the use of live animals or without the assistance of another person. The present invention provides such a system.

SUMMARY OF THE INVENTION

In accordance with the present invention there is provided a system for practicing the art of roping a moving target (e.g., a calf or steer) which does not require the use of live animals. The system of the invention comprises:

(a) stationary support means adapted to support the person roping;

(b) movable target means simulating an animal to be roped (e.g., a calf or steer); and (c) propelling means, actuatable by the person roping, which is adapted to propel the target means away from the stationary support means in a manner such that the person may practice the art of roping the target.

Since the system of this invention does not require the use of live animals, a person may practice roping anywhere without the need for special facilities or animal handling equipment. Thus, a person may practice the art of roping in his driveway or on the patio without the expense and bother associated with the use of live animals. Furthermore, the unpredictability associated with the use of an untrained roping horse is avoided. This enables the roper to concentrate solely upon the act of roping without interference from extraneous factors.

The system of the invention enables even children to practice the art of roping without risk of being injured by any live animal and without risk of injury to any animal. Furthermore, the action of the moving target closely simulates the action of a running calf or steer and accordingly provides excellent means for practicing the art of roping a moving animal.

BRIEF DESCRIPTION OF THE DRAWINGS

The system of this invention is described in more detail hereinafter with reference to the accompanying drawings wherein like reference characters refer to the same parts throughout the several views and in which:

FIG. 5 is a side elevational view illustrating transport of one embodiment of stationary support means of the invention;

FIG. 6 is a perspective view of another embodiment of target means useful in the present invention;

DETAILED DESCRIPTION OF THE INVENTION

Figure 1:
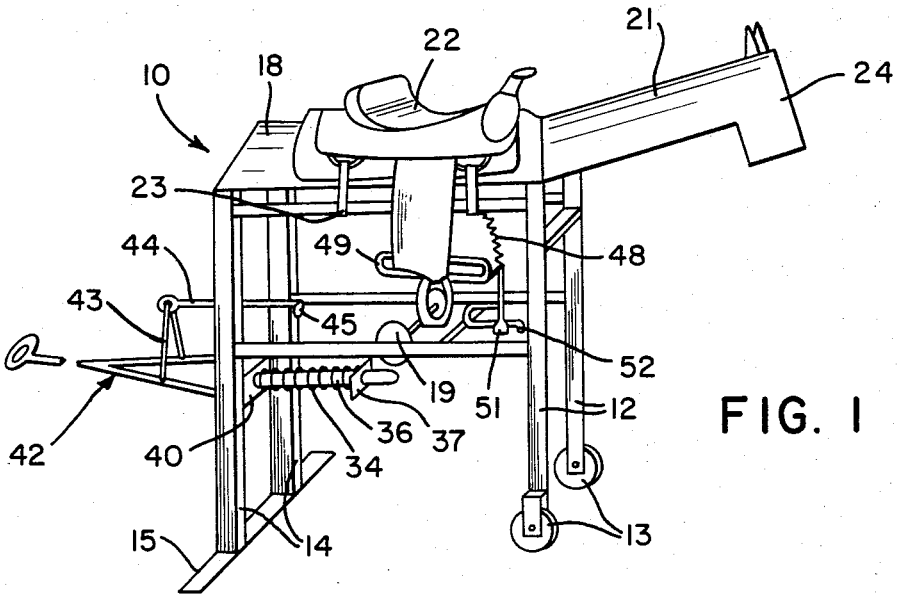
FIG. 1 is a perspective view of one embodiment of support means which is useful in the present invention.
Figure 2:
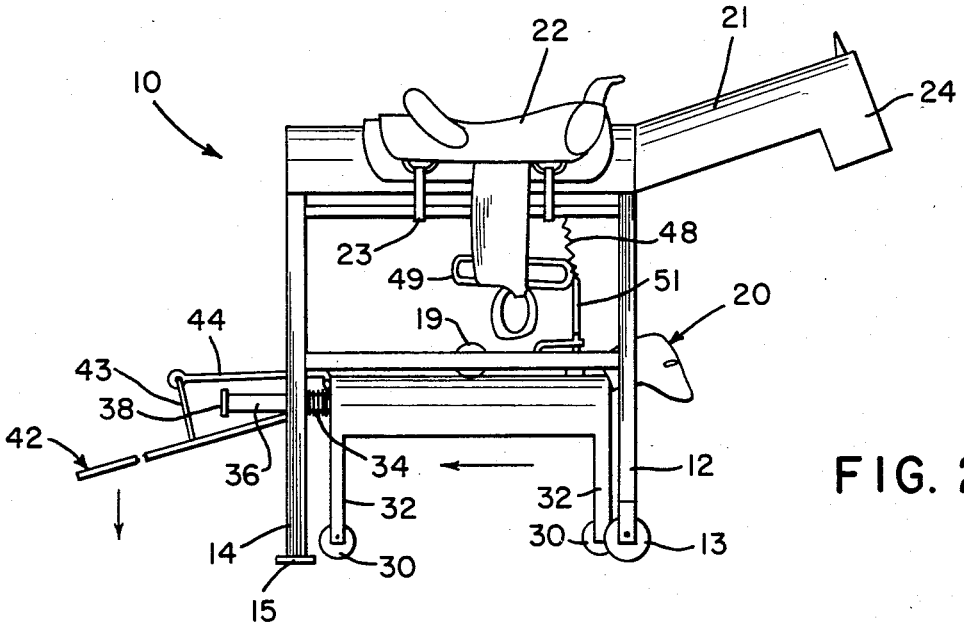
FIG. 2 is a side view of the support means of FIG. 1 in which a movable target is loaded into the support means.
Figure 3:
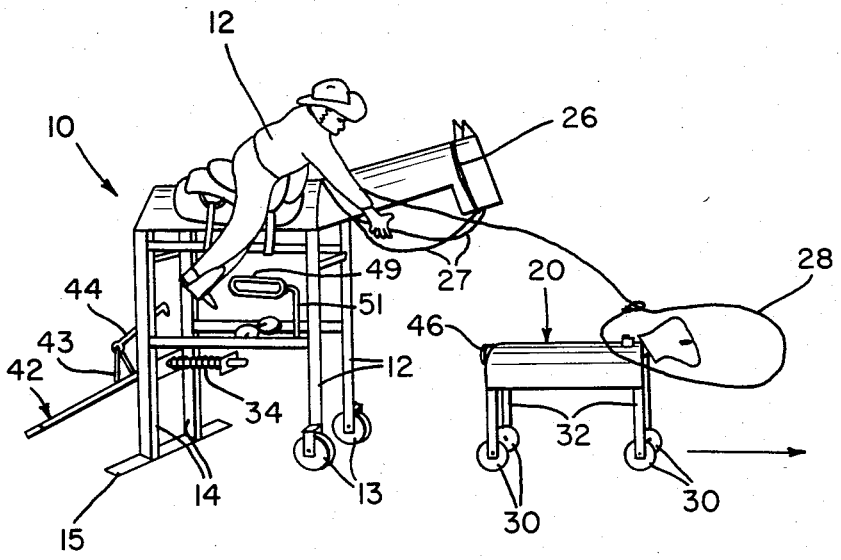
FIG. 3 is a perspective view of the apparatus of FIG. 2 illustrating the use of the apparatus in practicing the techniques of this invention.

In FIGS. 1, 2 and 3 there is shown one embodiment of the system of the invention. Stationary support means or frame 10 is adapted to support the person 12 in a seated position. Movable target means 20 simulating an animal to be roped by the person practicing is adapted to be propelled away from frame 10. The target means 20 may thus be roped while it is moving away from the frame means.

The frame 10 preferably includes upright support or leg members 12 at the front and support or leg members 14 at the rear. The front leg members are spaced apart and the rear leg members are also spaced apart so that a chamber or chute is defined between the two sides of the frame.

Preferably rotatable wheels 13 are carried by the lower end of each front leg member. A horizontal base plate 15 is attached to the lower ends of the rear legs 14. This provides a very stable support base for frame 10 but also enables the frame to be easily and conveniently moved, when desired. The rear of the frame can be lifted slightly so that the frame will roll on wheels 13. To further facilitate movement of the frame 10 a pair of elongated handles 16 may be pivotably attached at one of their ends to legs 14, as shown in FIG. 5 where bolt or pin 17 pivotably attaches one end of handle 16 to leg 14. Normally the elongated handle is in the vertical position (shown with dotted lines) when not in use. When it is desired to move the frame the handle 16 on each leg 14 is lifted to the horizontal position (as shown). Further lifting of handles 16 lifts the rear of frame 10. The frame can then be easily moved, much the same as moving a common wheel barrow.

The frame 10 also includes elongated backbone portion 18 which connects the upper ends of the front and rear leg members and also provides support means for saddle 22 or other desired seat. The saddle 22 may be secured, for example, by means of conventional straps 23.

The height of frame or support means 10 may vary, although it normally is in the range of about 4–5 feet. The width of the frame may also vary. Generally, however, a width of 2–3 feet is sufficient.

Although not required, the frame or support 10 may more closely simulate a horse when it is provided with neck 21 and head member 24. This is shown in FIGS. 1, 2 and 3. A bridle 26 and reins 27 may also be included, if desired. This is illustrated in FIG. 3.

A movable target is used in cooperation with the frame or support member. Preferably the target is adapted to be initially retained within the frame member until the person roping desires the target to be propelled outwardly away from the frame member.

The movable target normally simulates a calf or a steer with horns, depending upon the type of roping being practiced. In FIGS. 2 and 3 the target simulates a calf and in FIG. 6 the target simulates a horned steer. The target could also simulate other animals, if desired, for example, a goat.

Although it is preferred for the target to be initially retained in an open chamber or chute within the frame means, it is also possible for the target to be initially positioned outside of the frame, if desired. For example, the target could be adapted to be initially retained in front of the frame or off to one side of the frame. The preferred embodiment, however, is to have the target initially retained within an open chamber or chute within the frame. This is shown and illustrated in FIG. 2.

The target is propelled away from the frame (as illustrated in FIG. 3) so that the person 12 may practice the art of catching the target with rope 28 which is thrown while the person 12 is supported on frame 10. The target 20 preferably includes rotatable wheels 30 carried on the lower ends of legs 32 to facilitate low friction movement of the target as it is propelled away from frame 10. Alternatively, the target could be mounted on a track extending outwardly away from frame 10. If desired, the target could include appropriate skids instead of rotatable wheels to support itself.

The means for propelling the target is preferably a collapsible spring 34. As shown in FIGS. 1–3, spring 34 surrounds rod 36. The leading end of rod 36 includes fixed plate 37 securely fastened to rod 36. The opposite end 38 of rod 36 is positioned outside of brace member 40 and is enlarged so that it cannot pass through the opening in brace 40. Rod 36 is adapted to slide within the opening in brace 40. Accordingly, as rod 36 is moved rearwardly, the spring 34 is compressed between brace 40 and plate 37. When rod 36 is accelerated forwardly by the action of spring 34, the plate 37 pushes against the target and propels it away from the frame 10.

One means for loading the target 20 into the open chamber within frame 10 is illustrated in the drawings. Lever 42 is pivotably attached at one end to brace 40 of frame 10. Strut member 43 is secured to lever 42 at a point between its ends and preferably at a right angle to lever 42. Arm 44 is pivotably attached at one end to strut member 43, as shown. The opposite end of arm 44 includes downwardly depending finger 45 which is adapted to engage a U-shaped stirrup or handle 46 carried at the rear of target 20. As the free end of lever 42 is pushed downwardly, arm 44 draws target 20 into the chamber (in the direction indicated by the arrow in FIG. 2) against the action of spring 34. As a result, spring 34 is compressed. Guide wheels 19 carried between the sides of the frame hold the target 20 level and prevent the front end of the target from raising upward as the target is pulled into the frame against the action of the spring 34. A latch means carried by the frame member then secures the target in position until the person 12 desires to activate the propelling means.

Figure 4:
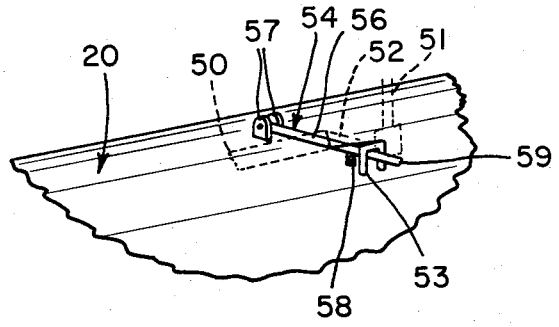
FIG. 4 is a perspective view illustrating one type of clip means supported by the top or back of the target which is adapted to releasably engage a latch means carried by the stationary support.

One manner of securing the target 20 within frame 10 is illustrated in FIG. 4. Latch 50 comprises an elongated member carried in a non-movable position by frame 10. The outer end 52 of latch 50 is curved downwardly so as to form a hook. A clip member 54 carried on the top of the target 20 is adapted to be detachably engaged by end 52 of latch means 50. Clip member 54 comprises rod 56 which is pivotably supported at one end by supports 57. Spring 58 biases the opposite end 59 of rod 56 to a normally upward position within U-shaped guide 53. Downwardly depending arm 51 is operatively connected to kick plate 49. Spring member 48 biases arm 51 to a normally upward position. When the person roping desires to have the target 20 propelled away from the frame 10 he kicks inwardly against plate 49. This causes arm 51 to move downwardly, and the lower end of arm 51 pushes downwardly on end 59 of rod 56. When rod 56 is thus pushed downwardly it becomes detached from end 52 of latch 50. This then permits the target 20 to be propelled outwardly away from the frame.

The speed at which the target is propelled away from frame 10 is dependent upon the strength of spring 34. Optionally, a second spring may be carried by the rear portion of the target to increase the speed of the propelled target. This is illustrated in FIG. 6, for example. Alternatively, a stronger spring may be used in the frame.

Another embodiment of target 60 is shown in FIG. 6. The target 60 includes a body member 62 carried by leg members 32. A rotatable wheel 30 is attached to the lower end of each leg member. The body member 62 may be made of plastic (e.g., polyvinylchloride) or metal, for example. A simulated head 64 is attached to the front end of the target. Horns 66 may be secured to the head member 64 (e.g., by means of elastic band or tie 65) to simulate a steer. That is, the target 60 may be used to practice roping of the horns 66 as opposed to roping the target around the head portion 64.

The embodiment of target 60 shown in FIG. 6 also includes a spring member 35 which will be compressed in the same manner as spring 34 when the target is drawn into the frame. The presence of spring 35 imparts additional speed to the propelled target.

Figure 7:
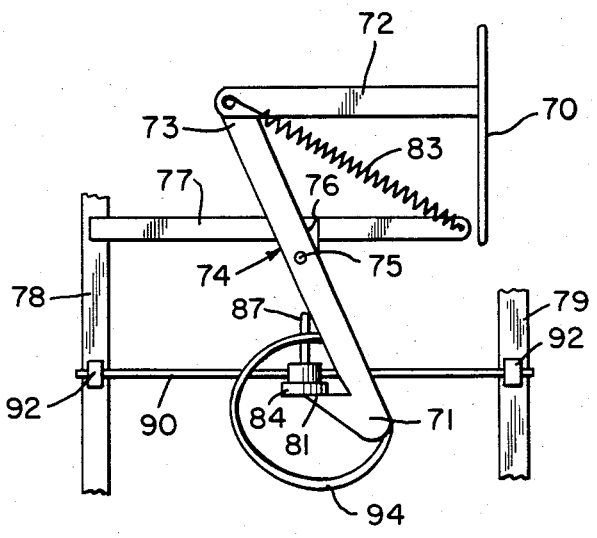
FIG. 7 is a top view of one type of actuating means useful in the present invention.

FIG. 7 is a top view of another type of actuating means which is useful in the apparatus of the present invention. Pressure plate or kick plate 70 is attached securely to one end of arm 72. Plate 70 is adapted to be pushed or kicked inwardly with the foot of the person roping. When the arm 72 is moved inwardly it also moves end 73 of pivot arm 74 which is pivotably mounted near its mid-point on bolt 75. Strut member 76 supports bolt 75 and is securely attached at one end to brace member 77. Brace member 77 is carried by cross-braces 78 and 79 extending between the upright legs of the frame.

The opposite end 71 of pivot arm 74 includes finger 81. Spring member 83 is attached at one end to arm 72 and at its other end to a point on brace member 77 in such a manner that arm 72 and kick plate 70 are biased to a normally outward position. When the kick plate 70 is pushed inwardly end 71 of pivot arm 74 is moved outwardly. Finger 81 is thus moved out of engagement with the upper end 84 of upstanding arm 85. Latch finger 87 carried by arm 85 is thus able to move upwardly away from the front edge of catch means 88 carried by target 80. The compressed spring 34 then propels the target outwardly from the frame.

Arm 85 is pivotably supported near its lower end on shaft 90. Each end of shaft 90 is supported by mounts 92 fastened to cross-brace members 78 and 79.

Loop 94 carried by pivot arm 74 retains the upper end 84 of arm 85 so that end 84 remains in close proximity to end 71 of arm 74 after it is released from finger 81. This facilitates the re-engagement of end 84 of arm 85 with finger 81 when the target is again drawn into the frame.

Figure 8:
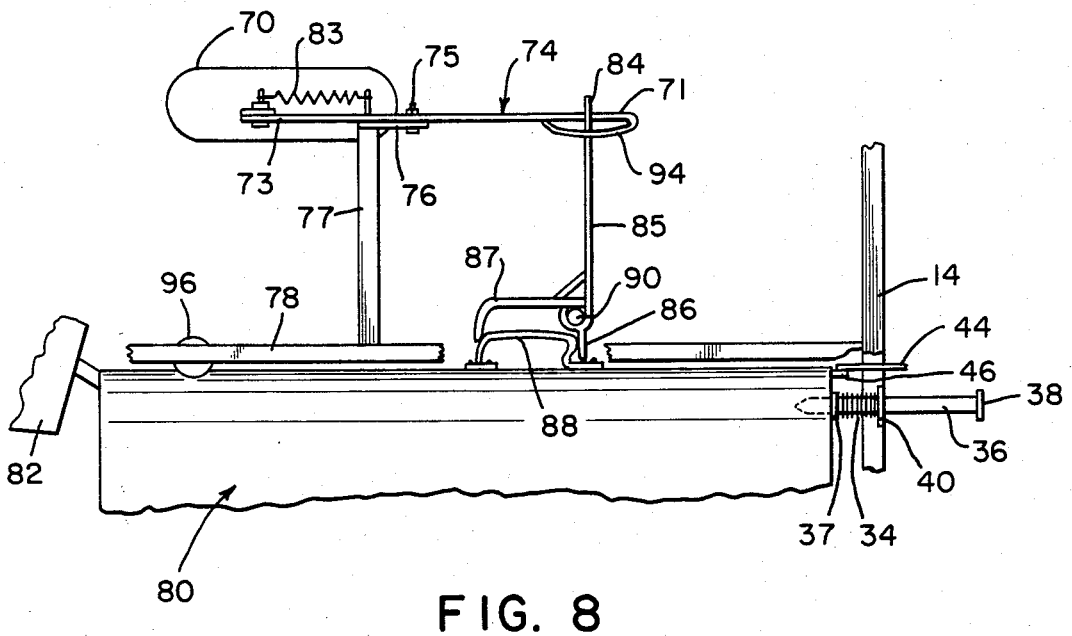
FIG. 8 is an elevational view of the actuating means shown in FIG. 7.

The lower end of arm 85 includes finger 86 which is adapted to engage the rear of catch means 88 as target 80 is drawn into the frame. This causes arm 85 to tilt forward and latch finger 87 to engage the front portion of catch means 88 (as shown in FIG. 8).

Guide wheel 96 rotatably carried within the frame is adapted to rest against the top surface of target 80 and prevent the front end of the target from rising when the target is drawn into the frame. Preferably there are two of such guide wheels.

Other variants are possible without departing from the scope of the present invention.

What is claimed is:

1. A system for practicing the art of roping a moving target simulating an animal; said system comprising:

(a) stationary support means adapted to support the person roping in a seated position;

(b) movable target means simulating an animal to be roped;

(c) propelling means adapted to propel said target means away from said stationary support means in a manner such that said person may practice the art of roping said target means; and (d) actuating means, controlled by said person, which is adapted to actuate said propelling means.

2. A system in accordance with claim 1, wherein said movable target means includes a plurality of rotatable wheels which support said target and enable it to roll on said wheels.

3. A system in accordance with claim 1, wherein said stationary support means is open at the front and wherein said movable target is adapted to be retained within said stationary support means prior to being propelled away therefrom.

4. A system in accordance with claim 1, wherein said propelling means comprises a spring carried by said stationary support means.

5. A system in accordance with claim 4, further comprising a second spring carried by said target means.

6. A system in accordance with claim 3, wherein said stationary support further includes latch means adapted to engage said target means and retain said target means within said stationary support means.

7. A system in accordance with claim 6, wherein said actuating means is adapted to release said latch means, whereby said propelling means propels said target means away from said stationary support.

8. A system in accordance with claim 7, wherein said actuating means comprises an elongated arm which is pivotably mounted to the side of said stationary support, wherein the upper end of said arm is adapted to be moved inwardly by said person, and wherein the lower end of said arm is adapted to release said latch means.

9. A system in accordance with claim 1, wherein said target means simulates a calf.

10. A system in accordance with claim 1, wherein said target means simulates a steer with horns.

11. A system in accordance with claim 3, wherein said stationary support further includes pivotably mounted lever means adapted to be removably attached to said target means and being further adapted to draw said target means into said stationary support means.

12. A system for practicing the art of roping a moving target simulating an animal, said system comprising:

(a) stationary support means adapted to support the person roping in a seated position, wherein said stationary support means includes a chamber therein which is open at the front end;

(b) movable target means simulating an animal to be roped; said target means being adapted to be retained in said chamber prior to being propelled away therefrom;

(c) propelling means adapted to propel said target means out of said chamber and away from said stationary support in a manner such that said person may practice the art of roping said target means; and (d) actuating means, controlled by said person, which is adapted to actuate said propelling means.

13. A system in accordance with claim 12, wherein said movable target includes a plurality of rotatable wheels which support said target and enable it to roll on said wheels.

14. A system in accordance with claim 12, wherein said propelling means comprises a spring.

15. A system in accordance with claim 12, wherein said stationary support further includes latch means adapted to engage said target means and retain said target means within said stationary support means.

16. A system in accordance with claim 15, wherein said actuating means comprises an elongated arm which is pivotably mounted, wherein one end of said arm is adapted to be moved inwardly by said person, and wherein the opposite end of said arm is adapted to release said latch means.

17. A system in accordance with claim 16, wherein said latch means comprises a finger, and wherein the top surface of said target means includes a clip member which is engageable by said finger when said target is positioned within said chamber.

18. A system in accordance with claim 17, wherein said clip member is normally biased upwardly by spring means, and wherein said lower end of said arm of said actuating means is adapted to move said clip member downwardly to release said clip member from said finger.

19. A system in accordance with claim 12, wherein said stationary support means further includes rotatable guide wheels which are adapted to contact the top surface of said target means.

20. A system in accordance with claim 12, wherein said stationary support means includes front and rear supporting leg members.

21. A system in accordance with claim 20, wherein the lower end of each said front supporting leg member includes a rotatable wheel, whereby the rear end of said support member may be lifted so as to permit wheeled transport of said support member from one location to another.

* * * * *